United States Patent [19]

McKindary

[11] Patent Number: 4,754,677

[45] Date of Patent: Jul. 5, 1988

[54] BUTTRESSED EDGE CUTTING TOOL

[75] Inventor: Thomas W. McKindary, Totowa Boro, N.J.

[73] Assignee: Serrated Rule Corp., Hawthorne, N.J.

[21] Appl. No.: 59,427

[22] Filed: Jun. 8, 1987

[51] Int. Cl.[4] ..... B26D 1/00

[52] U.S. Cl. ..... 83/697; 83/694

[58] Field of Search ..... 83/679, 697, 694

[56] References Cited

U.S. PATENT DOCUMENTS 3,277,764 10/1966 Henc ..... 83/679

FOREIGN PATENT DOCUMENTS 222653 5/1967 U.S.S.R. ..... 83/697

*Primary Examiner*—E. R. Kazenske
*Assistant Examiner*—Eugenia A. Jones
*Attorney, Agent, or Firm*—Charles J. Brown

[57] ABSTRACT

A buttressed edge cutting tool wherein alternating buttresses and grooves are formed across blade faces with each groove having a depth fairing smoothly to zero at its end remote from the cutting edge.

8 Claims, 1 Drawing Sheet

BUTTRESSED EDGE CUTTING TOOL

BACKGROUND OF THE INVENTION

This invention relates to an improved cutting tool for use in cutting and blanking sheet material such as corrugated board. Cutting tools of the type with which the invention is concerned may have a generally straight cutting edge intended to be translated into cutting engagement with the sheet material supported on a flat base or platen or they may have a circular edge which is rolled into cutting engagement across the sheet material on the base or platen. In either case it is an object in the design of such cutting tools that they be sufficiently sharp and sleek to cut cleanly through the sheet material but at the same time be sturdy and thick enough to withstand repeated use without undue breakage or dulling of the cutting edge.

It is recognized in U.S. Pat. No. 3,277,764 to Henc that advantages are to be gained by forming the cutting edge of the tool so that arced portions or buttresses alternate with indentures or grooves across each face of the blade, with buttresses on one side aligned with the grooves on the other side. Such a cutting edge is scalloped in elevation and undulating as viewed on edge. A principal disadvantage of that particular design, however, is that the grooves or indentures are formed with an abrupt flat end remote from the cutting edge. As the tool cuts into sheet material and the buttresses and grooves force apart the severed edges of the material, the flat ends of the grooves come bluntly into contact with the severed edges and produce a crushing effect. It is a principal purpose of the present invention to improve upon the form of such grooves so that the severed edges are cleanly separated and little or no crushing of the sheet material takes place.

SUMMARY OF THE INVENTION

The invention provides a buttressed edge cutting tool having a shank portion with lateral faces extending from a pair of closely-spaced parallel edges on opposite sides of a lateral centerline of the tool. A blade portion has blade faces extending from the shank edges and converging at a certain acute included angle relative to the lateral centerline. Alternating buttresses and grooves are formed across each blade face with each groove having a depth fairing smoothly to zero at its end nearest the shank portion and with each buttress on one blade face aligned opposite one of the grooves on the other blade face. Bevels are formed at the ends of the buttresses and grooves remote from the shank portion and meet at an included angle relative to the lateral centerline which is less acute than the angle between the blade face and the lateral centerline and which form a cutting edge scalloped in elevation and undulating as viewed on edge.

In a preferred form of the invention each groove has a straight-line bottom parallel to the associated blade face and a depth which fairs to zero on the associated shank portion face. The angle between each blade face and the lateral centerline may be from about 6 to about 10 degrees with approximately 8 degrees being preferable. The angle between each buttress bevel and the lateral centerline may be from about 15 to about 25 degrees with approximately 20 degrees being preferable. The angle between each groove bevel and the lateral centerline may be from about 25 to about 35 degrees with approximately 30 degrees being preferable.

DESCRIPTION OF PREFERRED EMBODIMENT

Figure 1:
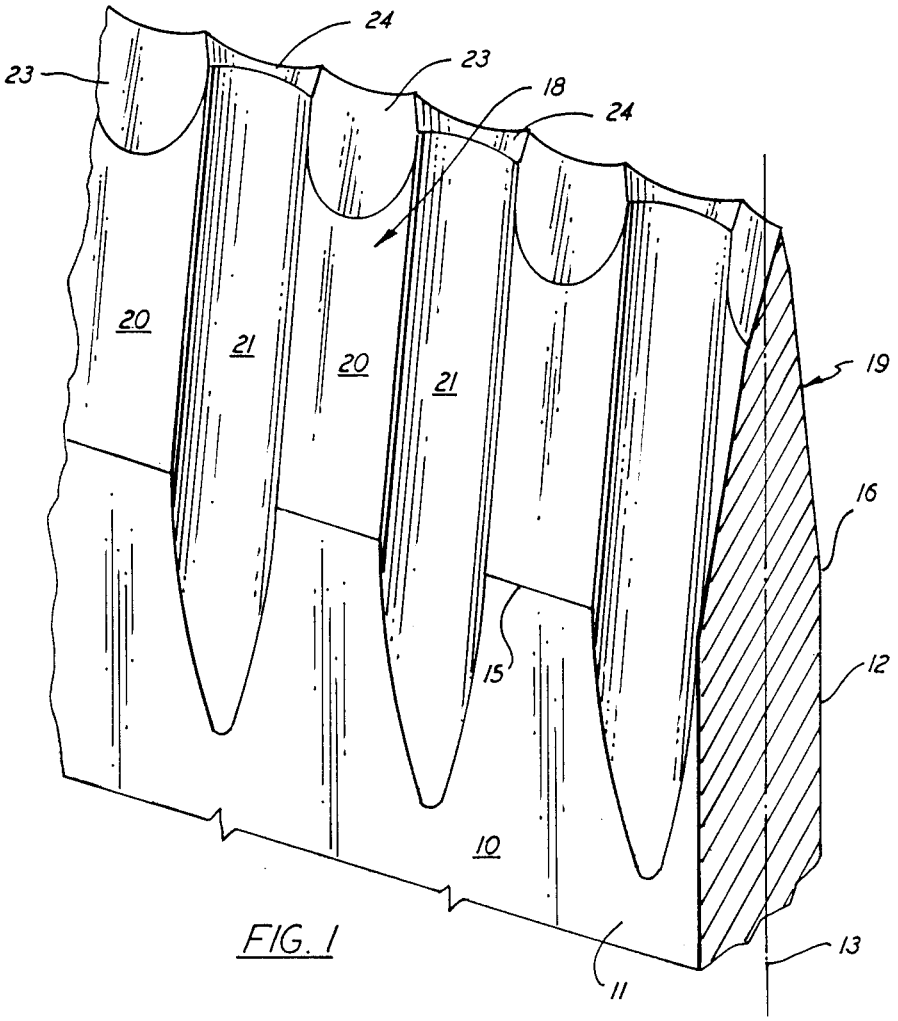
FIG. 1 is a fragmentary perspective of the blade portion and shank portion of the buttressed edge cutting tool of the invention.

The cutting tool of the invention may be of cold rolled spring steel from flat stock of typically of 0.056 inch thickness. The tool includes a shank portion 10 having flat lateral faces 11 and 12 disposed parallel to a lateral centerline 13 of the tool as shown in FIG. 1. The shank faces 11 and 12 extend from a pair of closely-spaced parallel edges 15 and 16.

The tool includes a blade portion 17 having converging blade faces 18 and 19 extending from the shank edges 15 and 16. Each blade face defines an included angle relative to the lateral centerline 13 of the tool of about 8 degrees. This angle may vary but in most cases will be in the range of 6 to 10 degrees. Alternating buttresses 20 and concave grooves 21 (i.e. in cross-section their profile is substantially semi-circular) are formed across each blade face 18 and 19. Each buttress crest is flat where it joins the associated blade face 18 or 19, which is why shank edges 15 and 16 are straight lines as shown in FIG. 1; however the crest of each buttress 20 is convex where it joins its associated first flat bevel 23, which is why their junction lines are curved and in the form of arcs as shown in FIG. 1. Each groove 21 has a straight line bottom parallel to its associated blade face 18 or 19. The depth of each groove 21 fairs to zero on the associated shank face as shown particularly in FIG. 1. The buttresses 20 on one blade face 18 are aligned opposite the grooves 21 on the other blade face 19.

Figure 2:
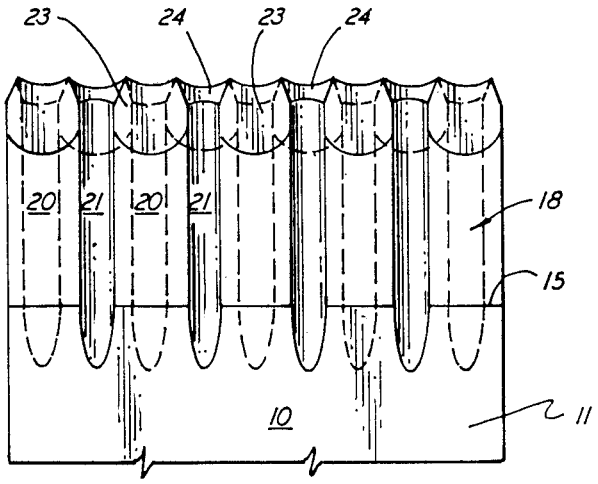
FIG. 2 is a side elevation of the tool of FIG. 1.

A first flat bevel 23 is formed at the end of each buttress 20 remote from the shank portion 10 and forms an included angle relative to the lateral centerline 13 of about 20 degrees. This angle may also vary but typically will be in the range of 15 to 25 degrees. A second flat bevel 24 is formed at the end of each groove 21 remote from the shank 10 and forms an included angle relative to the lateral centerline 13 of about 30 degrees. This too may vary but normally will be in the range of 25 to 35 degrees. The first and second bevels 23 and 24 form a continuous cutting edge which is scalloped in elevation (see FIG. 2) and undulating as viewed on edge (see FIG. 4 of the aforementioned Henc U.S. Pat. No. 3,277,764 for this typical undulating configuration).

As a cutting tool of this design severs sheet material, the blade faces 18 and 19 force the material apart and the buttresses 20 and grooves 21 slide with very little resistance against the edges of the severed sheet material. Since the grooves 21 fair smoothly in a straight line to their end opposite the cutting edge, the sheet material is not in any way subjected to crushing during the cutting action. This is in contrast to the design to Henc U.S. Pat. No. 3,277,764 where particularly in FIG. 1 thereof it is clear that each groove, or indenture to use its term, ends opposite the cutting edge in a squared-off flat end which bluntly crushes the severed material rather than smoothly wedges the severed material apart as in the present invention. The overall included angle of the blade faces 18 and 19 of the invention is notably acute so that sleekness and sharpness is enhanced, but even so the tool possesses considerable strength and durability due to the reinforcing effect of the buttresses 20.

I claim:

1. A buttressed edge cutting tool comprising (a) a shank portion having lateral faces extending from a pair of closely spaced parallel edges on opposite sides of a lateral centerline of the tool, (b) a blade portion having blade faces extending from the shank portion edges and converging at a certain acute included angle relative to the lateral centerline, (c) alternating buttresses and grooves formed across each blade face with each groove having a depth decreasing gradually to zero at its end nearest the shank portion and with each buttress on one blade face aligned opposite one of the grooves on the other blade face,and (d) bevels at the ends of all of the buttresses and all of the grooves on both blade faces remote from the shank portion and meeting at an included angle relative to the lateral centerline which is less acute than the angle between the blade face and the lateral centerline and forming a cutting edge scalloped in elevation and undulating as viewed on edge.

2. A buttressed edge cutting tool according to claim 1 wherein the angle between each blade face and the lateral centerline is from about 6 to about 10 degrees.

3. A buttressed edge cutting tool according to claim 2 wherein the angle between each blade face and the lateral centerline is about 8 degrees.

4. A buttressed edge cutting tool according to claim 1 wherein the angle between each buttress bevel and the lateral centerline is from about 15 to about 25 degrees.

5. A buttressed edge cutting tool according to claim 4 wherein the angle between each buttress bevel and the lateral centerline is about 20 degrees.

6. A buttressed edge cutting tool according to claim 1 wherein the angle between each groove bevel and the lateral centerline is from about 25 to about 35 degrees.

7. A buttressed edge cutting tool according to claim 6 wherein the angle between each groove bevel and the lateral centerline is about 30 degrees.

8. A buttressed edge cutting tool comprising (a) a shank portion having flat lateral faces parallel to a lateral centerline of the tool and extending from a pair of closely spaced parallel edges, (b) a blade portion having converging blade faces extending from the shank portion edges at an included angle relative to the lateral centerline of about 8 degrees, (c) alternating buttresses and concave grooves formed across each blade face with each groove having a straight-line bottom parallel to its associated blade face and a depth which decreases gradually to zero on its associated shank portion face and with each buttress on one blade face aligned opposite one of the grooves on the other blade face, (d) a first flat bevel at the end of every buttress on both blade faces remote from the shank portion at an included angle relative to the lateral centerline of about 20 degrees, and (e) a second flat bevel at the end of every groove on both blade faces remote from the shank portion at an included angle relative to the lateral centerline of about 30 degrees, (f) each buttress being convex where it adjoins its associated first flat bevel and flat-crested where it adjoins its associated blade face, (g) said first and second bevels forming a cutting edge scalloped in elevation and undulating as viewed on edge.

* * * * *